US007762116B2

(12) United States Patent
McVey et al.

(10) Patent No.: US 7,762,116 B2
(45) Date of Patent: Jul. 27, 2010

(54) BENDING BRAKE CARRIER LOCKING MECHANISM AND METHOD

(75) Inventors: Brian McVey, Machesney Park, IL (US); Jan Erik Börjesson, Götene (SE)

(73) Assignee: Roper Whitney of Rockford, Inc., Rockford, IL (US)

( * ) Notice: Subject to any disclaimer, the term of this patent is extended or adjusted under 35 U.S.C. 154(b) by 389 days.

(21) Appl. No.: 11/962,620

(22) Filed: Dec. 21, 2007

(65) Prior Publication Data

US 2009/0158796 A1 Jun. 25, 2009

(51) Int. Cl.
*B21D 5/04* (2006.01)
*B21D 43/00* (2006.01)

(52) U.S. Cl. ..... 72/319; 72/472; 72/477

(58) Field of Classification Search ..... 72/319, 72/320, 321, 322, 323, 472, 477
See application file for complete search history.

(56) References Cited

U.S. PATENT DOCUMENTS 3,656,390 A 4/1972 Hochstatter
4,646,599 A 3/1987 Benedict
4,669,346 A 6/1987 Benedict
4,879,894 A 11/1989 Benedict et al.
5,253,498 A 10/1993 Benedict
6,530,566 B1 * 3/2003 DuVernay ..... 269/228

OTHER PUBLICATIONS

Roper Whitney of Rockford, "Autobrake 2000 Model: AB1014 & AB1014K Parts Manual," (1993).

* cited by examiner

*Primary Examiner*—David B Jones
(74) *Attorney, Agent, or Firm*—Leydig, Voit & Mayer, Ltd

(57) ABSTRACT

A bending brake includes a rotating carrier that is rotatable about a rotation axis. The carrier has first and second upper jaws connected thereto at different angular locations about the rotation axis. A locking mechanism for preventing rotation of the carrier during operation of the bending brake includes an endplate forming a pocket, the endplate disposed adjacent to a distal end of the carrier. A latch having a trigger portion is pivotally connected to the endplate and located within the pocket such that the trigger portion protrudes from the pocket. A toothed cam wheel rotating with the carrier has at least one tooth formed thereon that engages the trigger portion of the latch to prevent rotation of the carrier in one direction at preselected angular positions corresponding to the first and second upper jaws.

22 Claims, 7 Drawing Sheets

- PRIOR ART -

- PRIOR ART -

BENDING BRAKE CARRIER LOCKING MECHANISM AND METHOD

FIELD OF THE INVENTION

This disclosure generally relates to box or pan bending machines, also known as brakes, and, more particularly, to a mechanism for locking an operating position of a carrier having multiple clamping jaws associated therewith.

BACKGROUND

Bending brakes are metalworking machines used for bending sheet metal to form various shapes, for example, box or pan shapes, gutters, and so forth. Specifically, a bending brake can be used to form single or compound bends and/or creases in a sheet of metal, at selected locations, to form various shapes. Formed metal sheets may subsequently be brazed, welded, or fastened along seams to form various structures.

A typical bending brake is capable of shaping different features onto a sheet of metal by use of differently shaped and sized clamping jaws. A lower jaw, which is typically embedded into a table work surface of the brake, cooperates with a vertically moveable upper jaw to "pinch" a cross section of the sheet material disposed therebetween. A bending beam may then twist a portion of metal sheet on one side of the pinched or clamped cross section to bend the sheet to a desired contour, shape, or angle. Modern bending brakes are mechanically, electrically, or hydraulically actuated computer-numerical controlled (CNC) machines. Some bending brakes also have the capability to carry more than one upper clamping jaw that can be selected when forming metal sheets into different shapes. Each of these upper clamping jaws may be selectively moveable into a service position above the lower clamping jaw during operation of the brake. An example of a bending brake having multiple selectively operative clamp jaws can be seen in U.S. Pat. No. 5,253,498 (the '498 patent), which issued on Oct. 19, 1993, to R. J. Benedict, and which is incorporated herein in its entirety by reference.

The '498 patent discloses a bending brake including a horizontal lower clamp jaw, a bending beam mounted for pivotal movement about a horizontal axis relative to the lower clamp jaw, and an upper jaw carrier mounted for vertical movement into and out of work clamping engagement with the lower jaw. The upper jaw carrier has a plurality of clamp jaws mounted at angularly spaced locations on the carrier and a carrier position control mechanism is provided for turning and locking the upper jaw carrier to selectively position different upper clamp jaws in an operational position relative to the lower clamp jaw.

The locking function of the control mechanism includes a locking member or pin slideably connected to the carrier. When locking the carrier, a mechanism operates to extend the pin into an opening formed in the frame of the machine to lock the carrier in place. The pin can be successively retracted when rotation of the carrier is desired and re-extended to lock the carrier into a different position or orientation. Even though this locking mechanism is effective in locking the angular position of the carrier during operation, repeated use and wear of the machine may cause misalignments when extending the pin into the opening, which can lead to time-consuming changeovers of upper clamping jaws during operation. Moreover, this design requires tight tolerances during assembly of the machine to ensure a proper fit of the pin in its extended position into the opening in the frame of the machine. These tight tolerances are costly to maintain and achieve in the manufacture and assembly of the bending brake.

Another known locking mechanism 130 for a rotatable carrier having one or more upper jaws associated therewith (not shown) is shown in cross section in FIGS. 1 and 2. The locking mechanism 130, as shown, is installed in or integrated with an endplate assembly 132 of a bending brake machine 134. The bending brake machine 134 includes a rotatable carrier or beam (not shown) that is mounted on an axle 136 and arranged to rotate about a horizontal axis 138 that extends in parallel to a table surface 140, as is known. The axle 136 includes a hub 142 proximate the endplate assembly 132 that is arranged to rotate with the axle 136 about the horizontal axis 138 and that is attached to a wheel 144 (partially shown in cross section). The wheel 144 has at least one radially protruding portion or finger 146 that rotates with the wheel 144 and activates a latching mechanism 148 to rotationally lock the axle 136 and, thus, the carrier (not shown) into a certain operating position. A cross section through the latching mechanism 148 is shown in FIG. 2.

Referring now to FIG. 2, the latching mechanism 148 includes a latch 150 that is pivotally connected to the endplate assembly 132 at a pin 152. The latch 150 is arranged to pivot relative to the endplate assembly 132 about a pivot axis 153 that is offset from and generally perpendicular to the horizontal axis 138. The latch 150 is arranged to be pivotally displaced into a pocket 154 formed within the endplate assembly 132 when the latch is pushed in a counterclockwise direction as shown in FIG. 2. When no longer pushed, the latch 150 is arranged to return to its original position by action of a compression spring 156 that is disposed between the endplate assembly 132 and the latch 150. The compression spring 156 is retained within a bore by a plug 158 and is further arranged to have a sliding connection to the latch 150 by a semi-spherical pin 160 disposed therebetween. The at-rest position of the latch 150 relative to the endplate assembly 132 can be set by a set pin 162 as shown. Lastly, a notch 164 is formed at the free end of the latch 150 that is arranged to engage the finger 146 of the wheel 144 when in the locked position.

During operation of the locking mechanism 130, the latch 150 of the latching mechanism 148 cooperates with the finger 146 to lock the position of the wheel 144 relative to the endplate assembly 132. More particularly, rotation of the wheel 144 causes motion of the finger 146 relative to the latch 150 in the direction from right to left as denoted by an arrow in FIG. 2, which illustrates two alternative positions of the finger 146 relative to the latch 150. The moving finger 146 contacts the latch 150 along its side surface, which is disposed at an angle, $\alpha$, of about 12 degrees as shown in the illustration of FIG. 2. Continued motion of the finger 146 causes the latch 150 to pivot into the pocket 154 and remain therein until the trailing edge of the finger 146 has cleared the latch 150. At that time, the latch 150 returns to its original position and engages the finger 146 into the notch 164, thus retaining the finger 146 and preventing its counter rotation.

Although the latching mechanism 130 is effective at securing the position of a carrier beam in a bending press, it has certain disadvantages. For one, repeated use of the latch 150 causes wear and pitting of the surface of the latch 150 that contacts the set pin 162, which can result in improper placement of the latch 150 during operation. Moreover, repeated motion of the latch 150 when it snaps back into position to secure the finger 146 causes impact loading on the free end of the latch in the area of the notch 164, which after repeated cycles can cause a portion of the tip of the latch 150 to crack or break off. Additionally, the at rest position of the latch 150 relative to the endplate assembly 132 may creep over time and with repeated use, for example, because of a change in the position of the set pin 162. Further, removal of material from the endplate assembly 132 to form the pocket 154 is a relatively costly manufacturing operation and, moreover, acts to locally weaken the endplate assembly 132 in the area around the pocket 154.

BRIEF SUMMARY OF THE DISCLOSURE

The disclosure provides, in one aspect, a locking mechanism for a carrier of a bending brake. The carrier has first and second upper jaws connected thereto at different angular locations about the rotation axis. An endplate forming a pocket and located adjacent to a distal end of the carrier includes a latch. The latch has a trigger portion and is pivotally connected to the endplate. The latch is located within the pocket such that the trigger portion protrudes from the pocket. A toothed cam wheel rotating with the carrier has at least one tooth formed thereon that engages the trigger portion of the latch. This engagement prevents rotation of the carrier in one direction when the carrier is at one of two preselected angular positions corresponding to the first and second upper jaws.

In another aspect, the disclosure provides a method for selectively preventing rotation of a carrier associated with a bending brake. The carrier can rotate in a first direction to align a selected one of a plurality of upper clamping jaws, which are angularly arranged thereon, with a lower clamping jaw. The carrier may tend to rotate along a second, opposite, direction during operation of the bending brake. The method of preventing rotation of the carrier along the second direction, while allowing rotation in the first direction, includes selectively rotating the carrier in the first direction with a drive mechanism from a locked position to a subsequent locked position. Rotation of the carrier causes rotation of a toothed cam wheel that is proportional to rotation of the carrier. A latch is pivotally rotated from a locked position by gradually pushing on a trigger portion formed on the latch with a tooth formed on the toothed cam wheel. The latch is released and returns to the locked position when it is no longer pushed by the tooth. When in the locked position, a surface of the tooth that extends radially with respect to the toothed cam wheel engages a stop formed on the trigger, thus preventing rotation of the carrier in the second or opposite direction.

DETAILED DESCRIPTION OF A PREFERRED EMBODIMENT

The issues mentioned above, along with other issues relating to the manufacture and operation of bending brakes, may be avoided with the locking mechanism for a bending brake disclosed herein. The locking mechanism described and shown in the figures is advantageously capable of allowing a quick changeover in the operating position of the carrier during operation of the bending brake. Moreover, the self-locking function of the mechanism makes the operation of the bending brake simpler than before and less reliant on tight tolerances, making its manufacture and maintenance less costly. These and other advantages will become evident from the description below. A bending brake having an improved locking mechanism for the angular position of the carrier is described and shown in the figures and associated description that follows.

Figure 1:
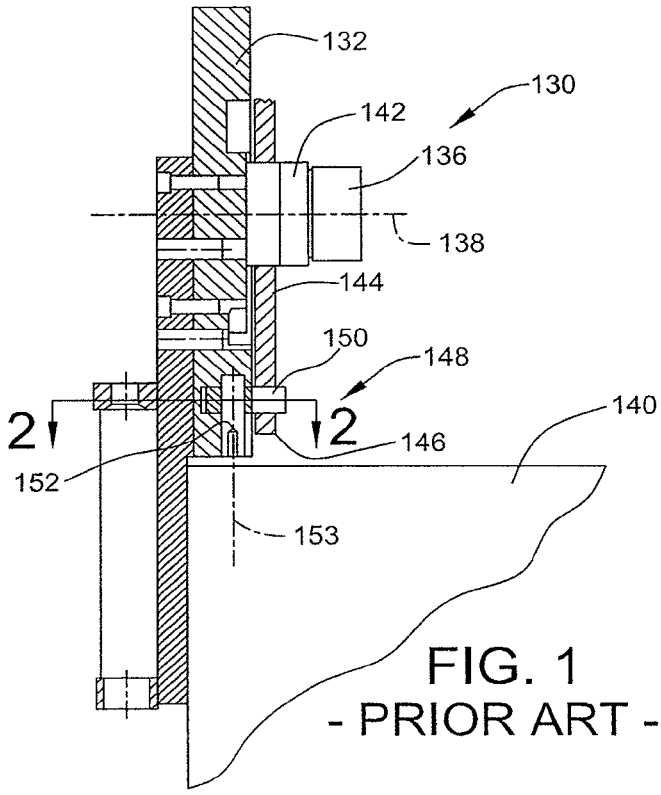
FIGS. 1 and 2 are cross sections of a known latching device.
Figure 2:
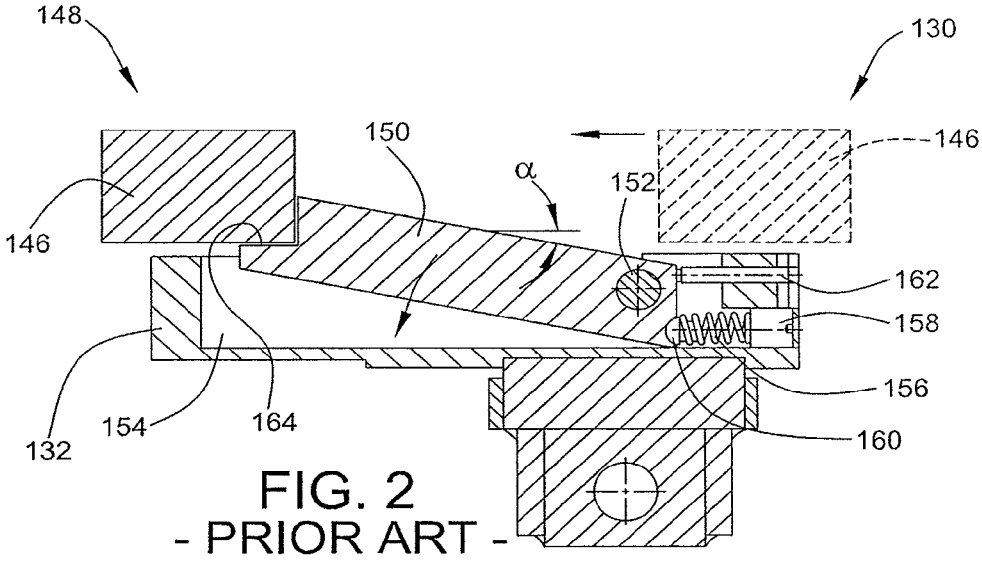
Figure 3:
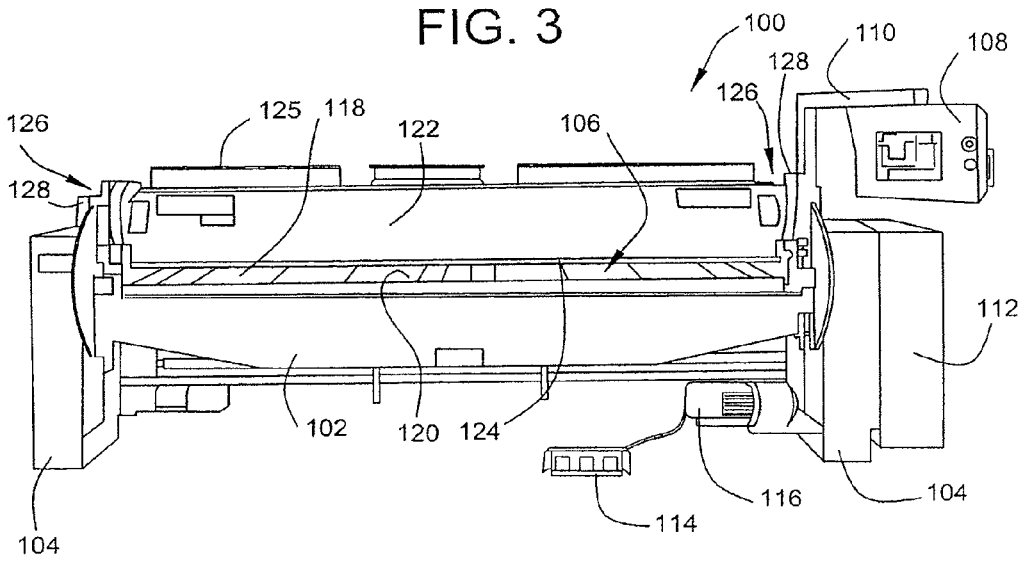
FIG. 3 is an outline view of a bending brake having a rotating carrier and a locking mechanism in accordance with the disclosure.

A bending brake 100 is shown in FIG. 3. The bending brake 100 includes a frame portion or bending beam 102 connected to two vertical support structures 104, with one support structure 104 located on either side of a working area 106. The working area 106 is configured to accept a sheet of metal (not shown) as a workpiece of the bending brake 100. During operation, a user may input a series of operations to be performed onto the workpiece to the bending brake 100 via an operator interface 108, which may be swiveled into position by an arm 110 and which communicates with an electronic controller 112. A foot switch 114 can safely actuate the bending brake 100. Actuation of the bending brake 100 can be controlled electrically or hydraulically. In this example, an electric motor 116 may operate to effect the bending functions of the bending brake 100 onto the workpiece located in the working area 106.

The working area 106 is surrounded by the support structures 104 and by a table surface 118. The table surface 118 is adjacent to a lower clamping jaw 120 and various other features that aid in guiding and retaining the workpiece during operation. A rotatable carrier 122 is located above the table surface 118 and arranged to vertically move with respect to the table surface 118 such that first and second upper clamping jaws 124 and 125 that are connected thereto, at different angular locations, can selectively cooperate with the lower clamping jaw 120. The rotatable carrier 122 is pivotally connected on either side of the working area 106 with hinged connections 126, which are capable of changing the angular position of the carrier 122 with respect to the table surface 118. One or both of the hinged connections 126 also include (s) a locking mechanism 128 capable of locking the angular position of the carrier 122 during operation.

During operation of the bending brake 100, the carrier 122 descends upon and clamps a cross section of sheet metal between the lower clamping jaw 120 and, depending on the orientation of the carrier 122, one of the first or second upper clamping jaws 124 and 125. After the cross section has been clamped, the bending beam 102 rotates around the support structures 104 pushing the sheet metal around the clamped cross section to create a bend or crease. The carrier 122 may then be lifted and the sheet repositioned for a subsequent operation, which may entail a re-orientation of the carrier 122.

Figure 4:
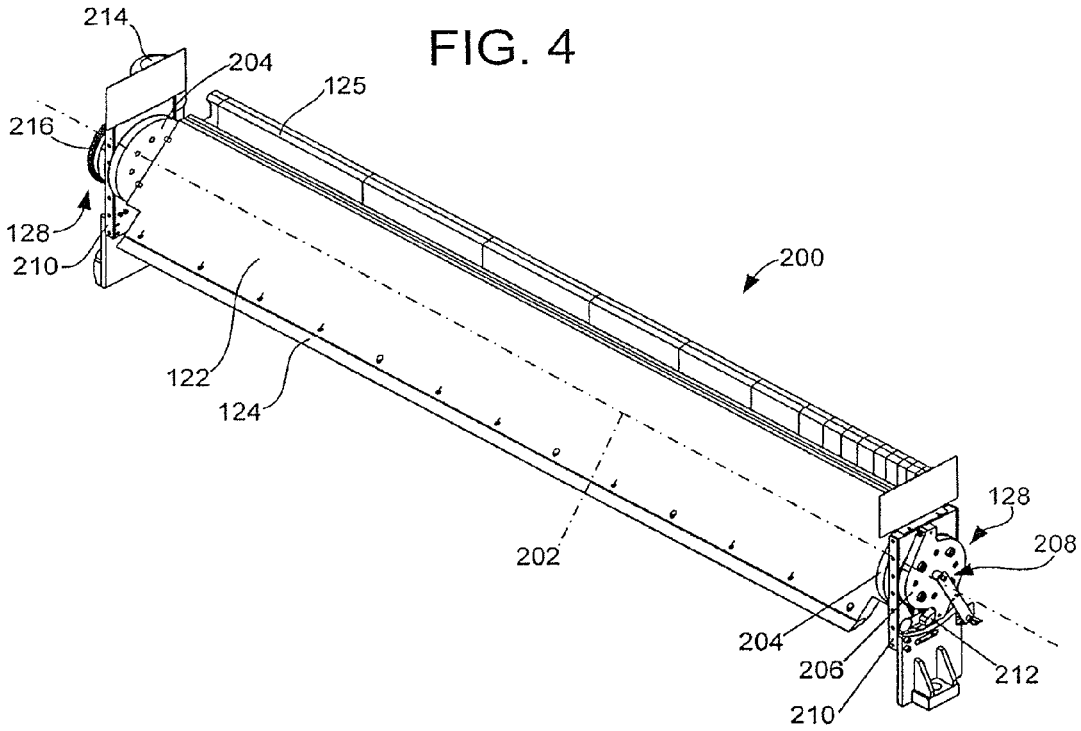
FIG. 4 is an assembly view of a carrier having a locking mechanism in accordance with the disclosure.

A carrier assembly 200, as installed on the bending brake 100 but shown separate therefrom for illustration of the locking mechanisms 128, is shown in FIG. 4. The carrier assembly 200 includes the carrier 122 that can rotate about a rotation axis 202. A set of hubs 204 are connected, one each, on either end of the carrier 122. Covers (not shown) may enclose and protect moving components, such as the locking and driving mechanisms associated with the carrier 122, when the bending brake 100 is fully assembled. These covers are not shown in FIG. 4 to reveal the components of the locking mechanism 128 for illustration.

Figure 7:
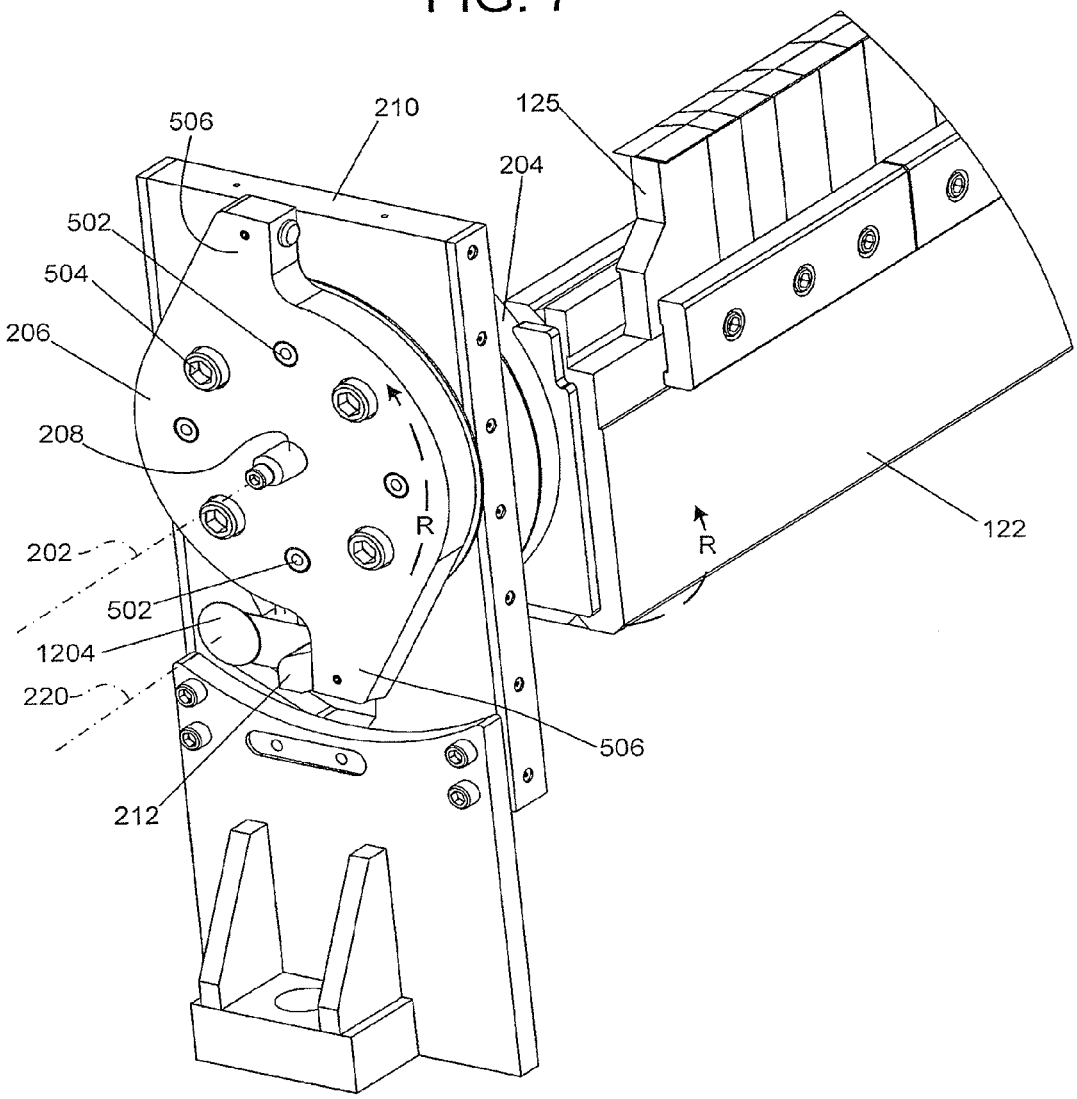
FIG. 7 is a close-up view of a locking mechanism in accordance with the disclosure.

The locking mechanism 128 includes a toothed cam wheel 206 connected to a hinge pin 208 and arranged to rotate proportionately with the carrier 122. The hinge pin 208 is connected to an extension of the carrier 122 along the rotation axis 204 to provide support and to rotateably connect the carrier 122 to the bending brake 100. The toothed cam wheel 206 is located adjacent to an endplate 210 that is rigidly mounted to the bending brake 100. The endplate 210 has a pin-mounted latch 212 attached thereto that is triggered as the toothed cam wheel 206 rotates. Rotation of the toothed cam wheel 206 along one direction can activate the latch 212, which can trigger and lock the toothed cam wheel 206 from counter-rotation at predetermined angles. The latch 212 is disposed to rotate about a latch pin 1204 about an axis 220 that is parallel to the rotation axis 202 of the carrier 122, as shown in FIG. 7 below. These predetermined angles may be spaced apart such that they coincide with the angular placements of the first and second upper clamping jaws 124 and 125.

Figure 5:
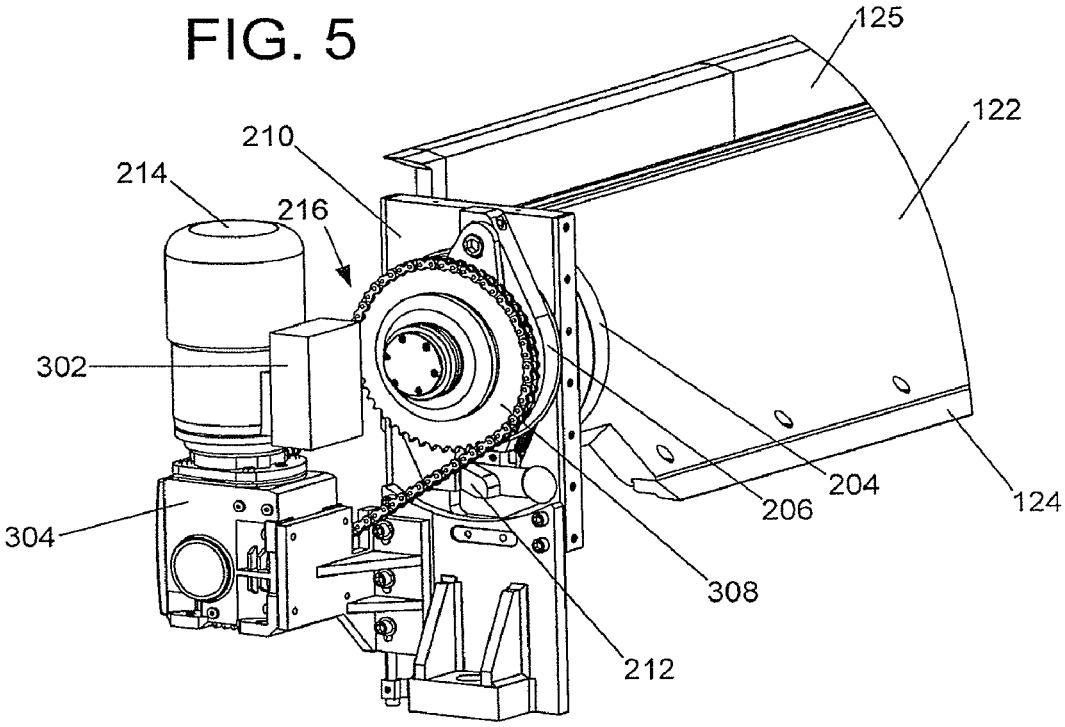
FIGS. 5 and 6 are outline views of a drive mechanism for rotating the carrier in accordance with the disclosure.
Figure 6:
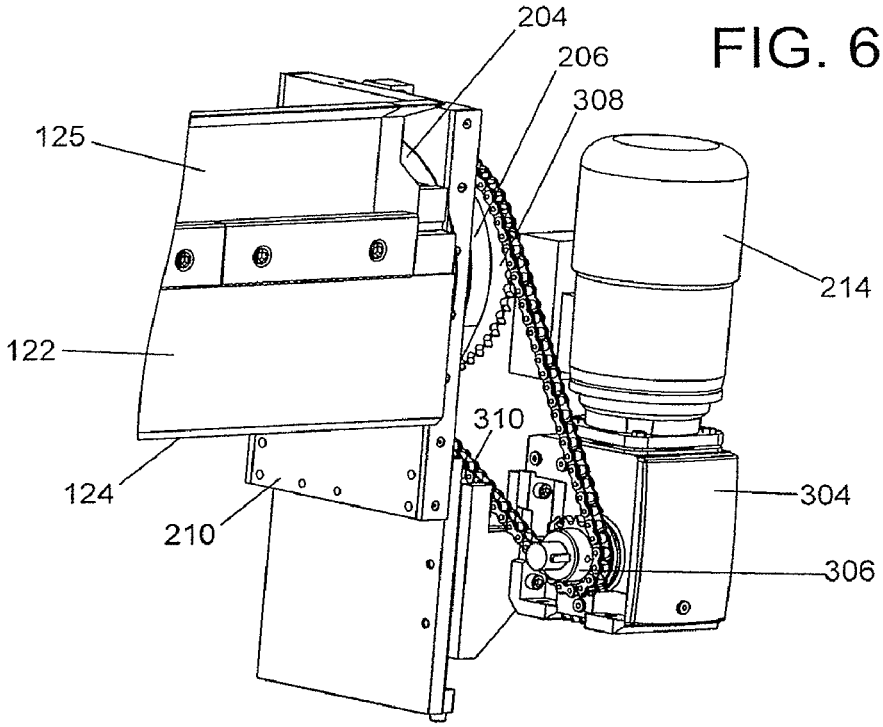

A carrier motor 214 connected to the carrier 122 via a chain drive 216 may operate to rotate the carrier 122 with respect to the rotation axis 202. The carrier motor 214 and chain drive 216 arrangement are shown in more detail in FIGS. 5 and 6. The carrier motor 214 is connected to a power source via a junction box 302, and operates in response to commands from the electronic controller 112. The power output of the carrier motor 214 is input to a gear box 304, which adjusts the speed and torque output of a pinion gear 306. The pinion gear 306 drives a carrier gear 308, which is connected to the carrier 122, via a chain 310. An angular position of the carrier 122 may be sensed by at least one or, in this embodiment, three proximity sensors (not shown) that relay a signal to the electronic controller 112 that is indicative of the angular position of the carrier 122. The controller 112 may process this signal to determine when and for how long the carrier motor 214 needs to operate during tool changeovers. Alternatively, the carrier motor 214 may be able to indicate the position of the carrier 122 directly to the electronic controller 112. Examples of such motors include stepper and servo motor arrangements.

As can be appreciated, rotation of the carrier 122 occurs in one direction during operation under the control of the carrier motor 214. Moreover, triggering of the latch 212 only depends on the angular position of the toothed cam wheel 206. Hence, the locking mechanism 128 is a self-locking mechanism that automatically engages the toothed cam wheel 206 when the carrier is in a desired position. Operation of the bending brake 100 advantageously requires only a rotational command for rotation of the carrier 122, and does not require a separate locking command. The locking mechanism disclosed herein is, at least in this respect, far more advantageous to the speed and accuracy of changeovers in upper clamping jaws during operation of the bending brake as compared to the known designs.

A detailed outline view of the locking mechanism 128 is shown in FIG. 7. The toothed cam wheel 206 is aligned with the hub 204 by four dowels 502 that are radially arranged around the rotation axis 202. Likewise, four bolts 504 connect the toothed cam wheel 206 with the hub 204. When the carrier 122 is rotating in a direction, R, about the rotation axis 202, the toothed cam wheel 206 will proportionately follow the rotation of the carrier 122, and each of two teeth 506 formed in the toothed cam wheel 206 will sequentially engage the latch 212. In the locked position depicted in FIG. 7, engagement of the tooth 506 with the latch 212 prevents rotation in a direction opposite the R direction due to engagement of each tooth 506 of the toothed cam wheel 206 with the latch 212. In the embodiment shown, each tooth 506 has a pin 508 integrated therewith and held in place by a set-screw 510 to allow for fine adjustments of the angular position of the carrier 122 with respect to the latch 212. The toothed cam wheel 206 and latch 212 are described in more detail below.

Figure 8:
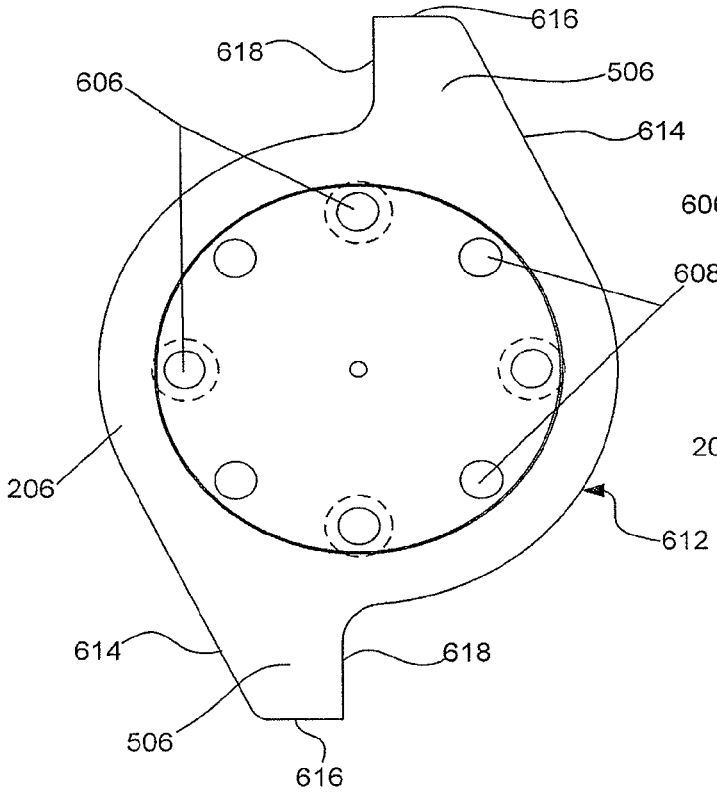
FIGS. 8 and 9 are various views of a toothed cam wheel in accordance with the disclosure.
Figure 9:
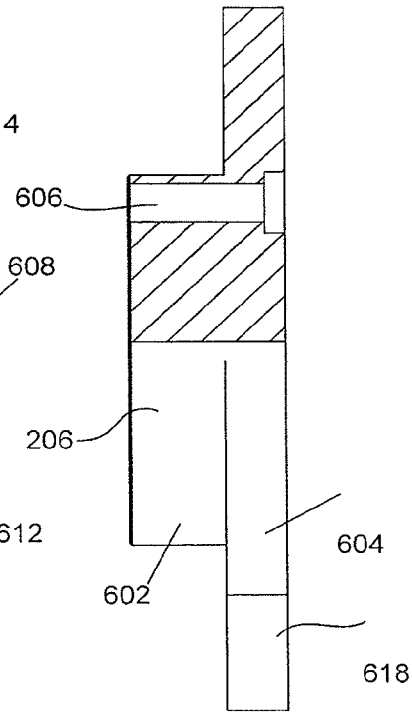

A side view, shown from the inner or machine perspective, and a partial section view of the toothed cam wheel 206 are shown in FIGS. 8 and 9. The toothed cam wheel 206 includes a hub portion 602 and a cam portion 604. The hub portion 602 occupies the central portion of the toothed cam wheel 206 and connects to a respective hub 204 of the carrier 122 when the bending brake 100 is assembled. The hub portion 602 forms four countersunk fastener openings 606 and four dowel openings 608, all of which extending through the hub portion 602 and used when connecting the toothed cam wheel 206 to the carrier 122.

The hub portion 602 has a generally cylindrical shape and is disposed on the inner or machine side of the toothed cam wheel 206 when assembled to the bending brake 100. The cam portion 604 forms each of the two teeth 506. The cam portion 604 has an outer or race surface 612 extending peripherally around the outer portion thereof. The race surface 612 is hurricane-shaped to allow for the desired cam actuation effect on the latch 212 when the toothed cam wheel 206 is rotating. The hurricane shape of the race surface includes a tangentially extending portion 614, which acts as ramp for the latch 212, a transition portion 616, which also extends tangentially but at a different angle than the tangentially extending portion 614, and a step or radially extending portion 618, which extends radially inward toward the center 620 of the toothed cam wheel 206.

Even though two teeth 506 are shown, it can be appreciated that fewer or more teeth can be formed on the toothed cam wheel 206. The number of teeth formed on a toothed cam wheel corresponds to the number of different operating positions of the carrier and, hence, to the number of selectively functioning upper clamping dies of the bending brake. For example, a bending brake having three upper clamping dies connected to its carrier and spaced 120 degrees apart might use a three-toothed cam wheel.

Figure 10:
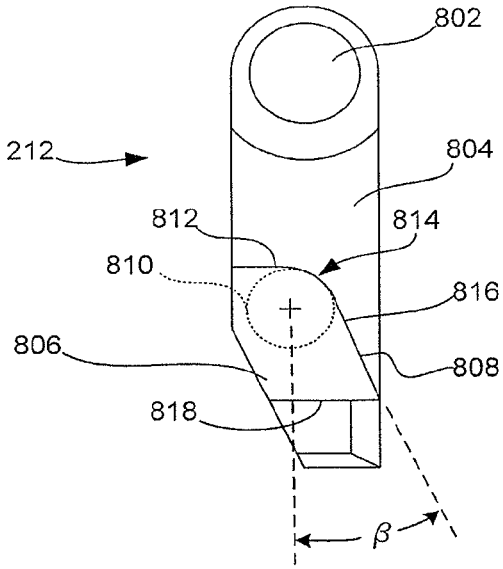
FIGS. 10 and 11 are views of a latch in accordance with the disclosure.
Figure 11:
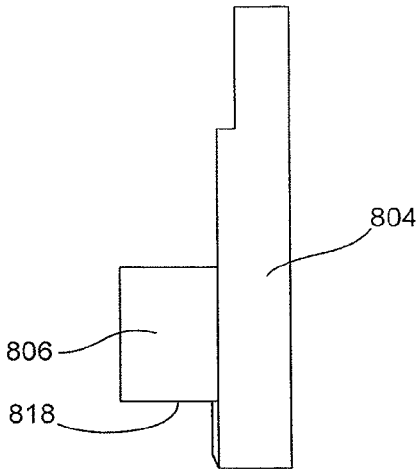

The profile of the toothed cam wheel 206 at a single tooth can be described as saw-tooth shaped, operating to gradually actuate and quickly release the latch 212. The latch 212 is arranged to pivot about the axis 220 of the latch pin 212 with respect to the bending brake 100 and to trigger into a self-locking position that prevents counter-rotation of the toothed cam wheel 206 when the latter assumes predetermined angular positions with respect to the latch 212. This self-locking relationship between the toothed cam wheel 206 and the latch 212 is the result of the cooperation between the two components. Two views of the latch 212 are shown in FIGS. 10 and 11 for illustration.

The latch 212 accommodates a pin 1204 (shown in FIG. 7) that passes through a pin opening 802 and that allows the pivoting motion of the latch 212. A body portion 804 of the latch 212 forms a trigger portion 806 close to a distal end thereof that is opposite the pin opening 802. The trigger portion 806 extends perpendicularly outward, with respect to the bending brake 100 and the body portion 804, and is the only portion of the latch 212 that contacts portions of the toothed cam wheel 206 when both components are assembled onto the bending brake 100. The trigger portion 806 forms a contacting surface 808 that slides against portions of the race surface 612 of the toothed cam wheel 206 during operation. The contacting surface 808 defines, with respect to an imaginary circle 810 (shown in dotted line), a first contacting portion 812 extending tangentially to the circle 810, a peripherally extending transition 814 and a second or release contacting portion 816, as illustrated in FIG. 10. The first contacting portion 812 is disposed at an angle, β, relative to horizontal (the latch 212 in shown rotated by 90 degrees in FIG. 10) when the latch 212 is in the as-installed position. As illustrated in FIG. 10, the angle β is about 20 degrees but, inherently, any angle between zero and 90 degrees may be used. Adjacent to the contacting surface 808 and extending past the release portion 816 is a flat locking surface 818. The latch 212 is associated with a respective endplate 210 when assembled onto the bending brake 100. The endplate 210 and its interrelation with the latch 212 are described below.

Figure 14:
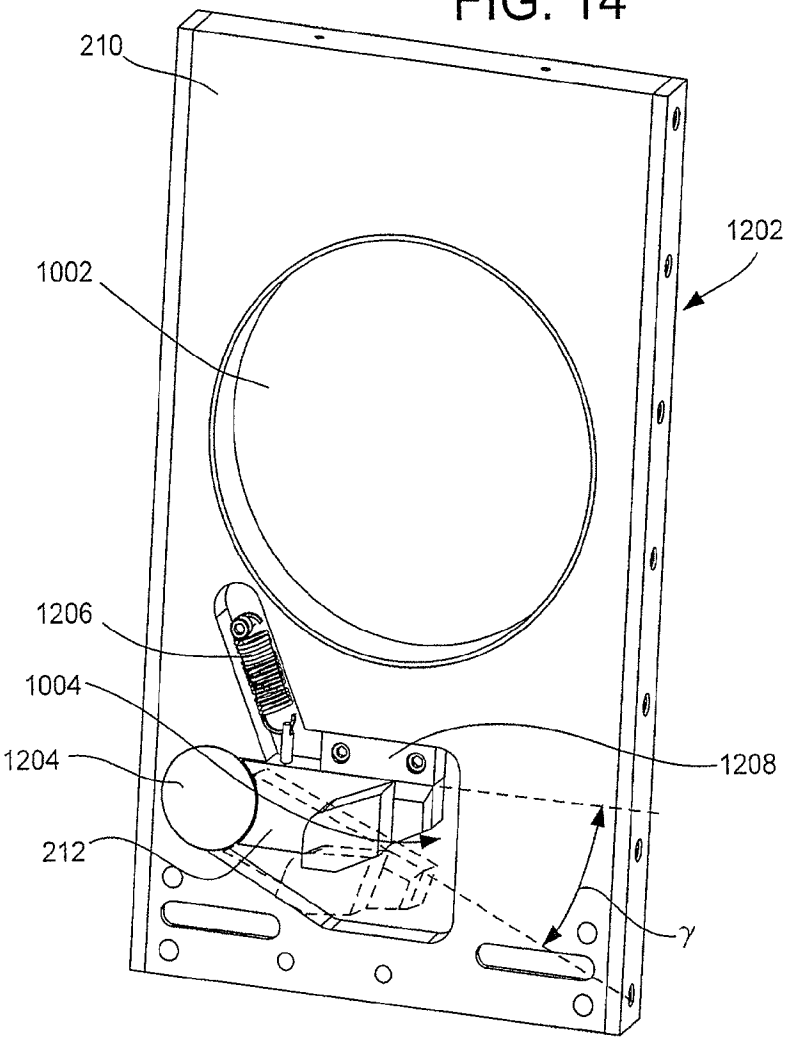
FIG. 14 is an outline view of an endplate having the latch operably associated therewith in accordance with the disclosure.
Figure 12:
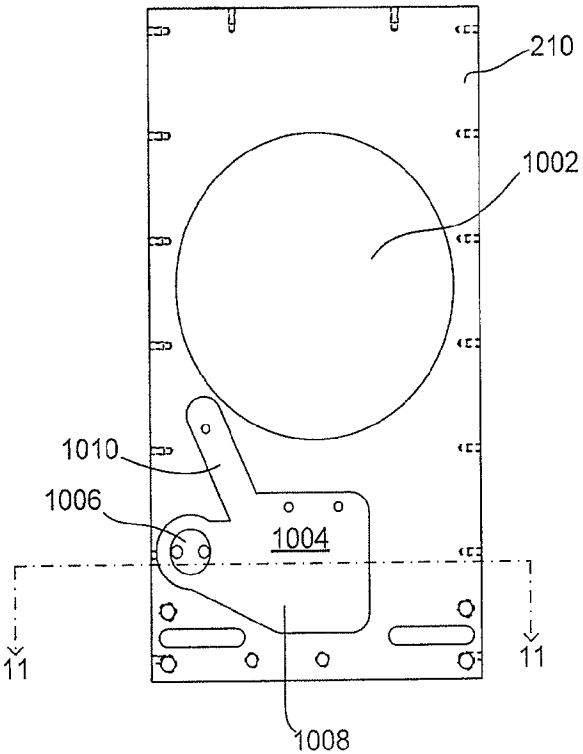
FIGS. 12 and 13 are views of an endplate in accordance with the disclosure.
Figure 13:
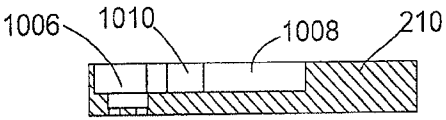

Outline and section views of the endplate 210 are shown in FIGS. 12 and 13, and an outline view of a trigger assembly 1202 that includes the endplate 210 and latch 212 is shown in FIG. 14. The endplate 210 forms a carrier opening 1002 that locates and rotateably supports the hub portion 602 of the toothed cam wheel 206 when the bending brake 100 is assembled. A pocket 1004 formed in the endplate 210 and located below the carrier opening 1002 accepts the latch 212. The pocket 1004 forms a pin pocket 1006 and a latch pocket 1008. When the latch 212 is assembled into the endplate 210, the pin 1204 is inserted through the pin opening 802 of the latch 212 (shown in FIG. 10), passes through the latch 212, and connects to the pin pocket 1006 of the endplate 210. The pivoting motion of the latch 212 is angularly limited by the latch pocket 1008 and, as shown in FIG. 14, is equal to an angle, γ, of about 21 degrees.

The position of the latch 212 within the latch pocket 1008 is biased toward a rest or locked position (as shown in FIG. 14) by a spring 1206. The spring 1206 is a tension spring that continuously pulls the latch 212 toward the locked position. The spring 1206 is located within a spring pocket 1010 formed in the endplate 210 and is connected between the endplate 210 and the body portion 804 of the latch 212. The locked position of the latch 212 within the latch pocket 1008 may be fine tuned or adjusted by connecting a stop block 1208 into the latch pocket 1008 such that the latch 212 pushes against the stop block 1208 when in the locked position. As can be appreciated, when the latch 212 is pushed away from the locked position toward an extended position (shown in dashed line), the biasing or tensile force applied by the spring 1206 increases. This increased spring force pulls the latch 212 back into the locked position and is responsible for giving the locking mechanism 128 its self-locking functionality.

Figure 16:
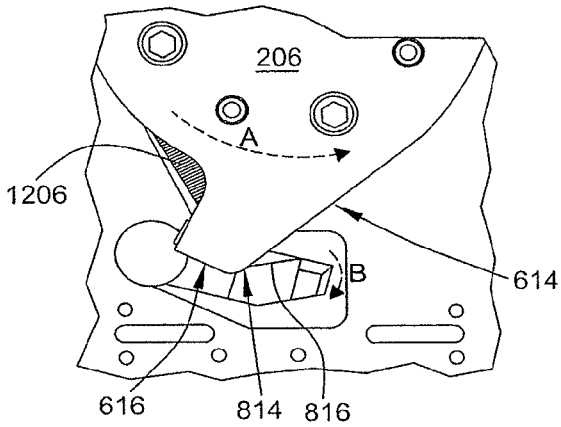
Figure 17:
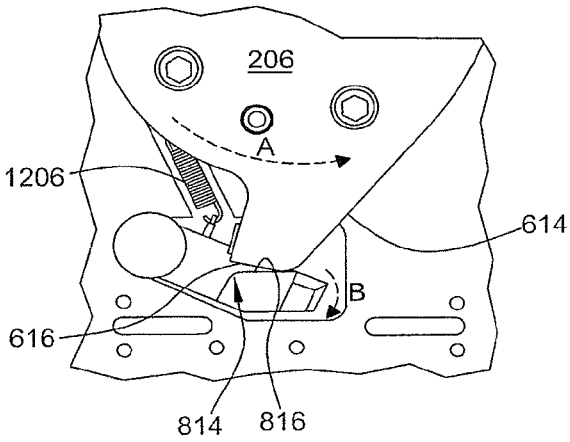
Figure 18:
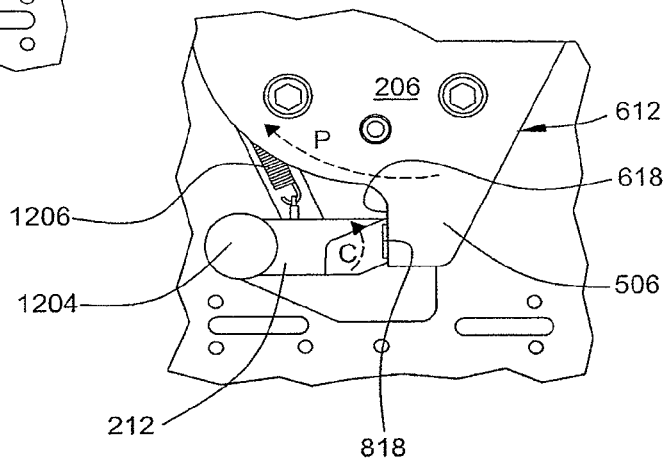

A series of illustrations or "snapshots" of the various positions assumed by the latch 212 as the toothed cam wheel 206 rotates during operation of the bending brake 100 are shown in FIGS. 15-18. A changeover process begins with the toothed cam wheel 206 being in the locked configuration, as shown in FIG. 18. While in the locked position, the locking surface 818 of the latch 212 is in contact with the radially extending portion 618 of the race surface 612 of the toothed cam wheel 206. In this state, the spring 1206 is in its least extended state.

During operation of the bending brake 100, each bending operation causes loading on the carrier 122 that tends to rotate the toothed cam wheel 206 in a pressing direction, P. Rotation of the toothed cam wheel 206 in the P direction is prevented by the latch 212. When a tool change is required, the carrier 122 and toothed cam wheel 206 are rotated, as described, in a tool changing direction, A.

Figure 15:
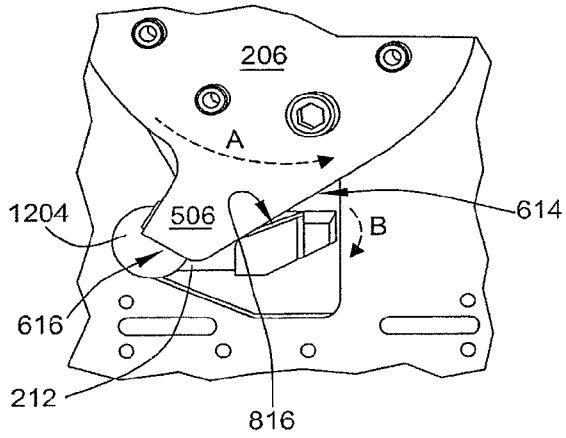
FIGS. 15 through 18 are detailed snapshot views of the function of the locking mechanism in accordance with the disclosure.

When rotation of the toothed cam wheel 206 along the A direction is initiated, contact between the radially extending portion 618 and the locking surface 818 is lost. The latch 212 remains in the locked position while the toothed cam wheel 206 rotates along the A direction. After the toothed cam wheel 206 has rotated less than a full revolution, one of the teeth 506 begins to approach the latch 212. Further rotation of the toothed cam wheel 206 brings the tangentially extending portion 614 of the tooth 506 in contact with the release portion 816, as shown in FIG. 15. The tooth 506 continues to push on the latch 212 causing it to pivot in an actuation direction, B, about the pin 1204 and away from the locked position. Continued rotation of the toothed cam wheel 206 along the A direction pushes the latch 212 further away from the locked position, extending the spring 1206. Contact of the tooth 506 with the latch 212 transitions from the tangentially extending portion 614 to the transition portion 616. Similarly, contact of the release portion 816 of the latch 212 with the tooth 506 transitions to contact with the peripherally extending transition 814, and then back to the release portion 816, as shown in FIGS. 16 and 17.

Eventually, contact between the tooth 506 and the latch 212 is lost as the edge of the transition portion 616 slides off the edge of the release portion 816. When this occurs, the latch 212 will snap back into the locked position along a locking direction, C, which causes the latch 212 to move along the radially extending portion 618 of the toothed cam wheel 206. Motion of the latch 212 along the locking direction C is caused primarily through action of the spring 1206. At this stage, the latch 212 returns to the locked position shown in FIG. 18 and rotation of the toothed cam wheel 206 in the pressing direction P is prevented. In some embodiments, the motor operating the carrier may "back-up" after the latch 212 returns to the locked position to ensure engagement of the latch 212 with the toothed cam wheel.

The embodiment described thus far is effective in automatically locking the angular position of the carrier 122 with respect to the rest of the bending brake 100 during changeovers between upper clamping jaws. The automatic or self-locking function of the angular position of the carrier is advantageous inasmuch as it avoids use of an actuator operating the locking mechanism, which simplifies operation of the bending brake by removing the need for a separate locking command to be issued by the controller. The locking mechanism is further advantageous for the manufacture and service of the bending brake in that the mechanism is less sensitive to dimensional tolerances between the various components. This is attributed, in part, to the design of the endplate that incorporates many of the features affecting operation of the various moving parts of the locking mechanism into a single component. In this fashion, stack-up of tolerances is avoided and dimensional accuracy can be controlled much more effectively.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A bending brake, comprising:

a horizontal table portion disposed adjacent to a lower jaw;

a carrier disposed above the table and rotatable about a rotation axis, the carrier moveable vertically with respect to the table;

a first upper jaw connected to the carrier and disposed parallel to the rotation axis;

a second upper jaw connected to the carrier and disposed parallel to the rotation axis, the second upper jaw disposed at an angle from the first upper jaw with respect to the rotation axis; and a locking mechanism including:

an endplate forming a pocket, the endplate disposed adjacent to a distal end of the carrier;

a latch having a body portion pivotally connected to the endplate and entirely disposed within the pocket, a trigger portion connected to the body portion and extending perpendicularly therefrom such that the latch is pivotally disposed in the pocket and arranged to rotate about an axis that is parallel to the rotation axis of the carrier, the trigger portion protruding from the pocket at all times;

a toothed cam wheel disposed on a distal end of the carrier and arranged to rotate therewith, the toothed cam wheel forming at least one tooth along an outer portion thereof, wherein the locking mechanism automatically locks to prevent rotation of the carrier in one direction at preselected angular positions corresponding to the first and second upper jaws.

2. The bending brake of claim 1, wherein the at least one tooth has a tangentially extending portion and a radially extending portion formed along the outer portion of the toothed cam wheel.

3. The bending brake of claim 2, wherein the at least one tooth acts to pivot the latch when, during rotation of the toothed cam wheel, the tangentially extending portion contacts a surface of the trigger portion.

4. The bending brake of claim 1, further including a spring connected between the endplate and the latch, wherein the spring biases the latch toward a locked position.

5. The bending brake of claim 1, wherein the pocket of the endplate has a pin portion and a latch portion, wherein the latch is disposed within the pocket and pivots about a pin disposed in the pin portion, and wherein the pin is disposed in parallel with the rotation axis of the carrier.

6. The bending brake of claim 5, wherein the trigger portion of the latch extends outside of the pocket at all times during a pivoting motion of the latch.

7. The bending brake of claim 1, wherein the trigger portion includes a contacting surface that is arranged to slidingly engage the at least one tooth of the toothed cam wheel and pivotally displace the latch while the toothed cam wheel rotates, and wherein the contacting surface comprises:

a circular cross section portion, a first contacting portion extending tangentially from the circular cross section portion at an angle, a transition portion extending peripherally along a segment of the circular cross section portion adjacent to the first contacting portion, and a release contacting portion extending tangentially from the circular cross section portion adjacent the transition portion.

8. The bending brake of claim 7, wherein the angle of the first contacting portion relative to a horizontal plane is twenty degrees, and wherein the release contacting portion is disposed perpendicularly relative to the horizontal plane when the latch is in a locked position.

9. A carrier assembly for use with a bending brake having at least two upper clamping jaws, the at least two clamping jaws disposed symmetrically around a rotation axis of the carrier assembly with respect to the bending brake, the carrier assembly comprising:

an elongate carrier having two hub plates, each hub plate disposed on each distal end of the elongate carrier and disposed concentrically with respect to the rotation axis;

a drive mechanism supported by the bending brake and operating to rotate the carrier assembly about the rotation axis;

at least one endplate supported by the bending brake, the at least one endplate disposed adjacent one of two distal ends of the elongate carrier and forming a latch pocket on a side thereof that is opposite the elongate carrier, the at least one endplate having a circular hub opening that is concentric with the rotation axis;

at least one toothed cam wheel connected to one of the two hub plates, the at least one toothed cam wheel having a hub portion and a cam portion, the hub portion of the at least one toothed cam wheel disposed within the hub opening; and a locking mechanism for preventing rotation of the elongate carrier with respect to the bending brake, the locking mechanism comprising:

a latch at least partially disposed in the latch pocket, the latch arranged to pivot about a pin disposed parallel to the rotation axis, the latch forming a trigger portion extending at least partially outside the pocket, the trigger portion defining a contacting surface and a locking surface;

wherein the toothed cam wheel forms at least one tangentially extending portion along an outer portion thereof, the at least one tangentially extending portion arranged to contact the contacting surface of the trigger portion when the elongate carrier is rotating, and at least one radially extending portion formed along the outer portion, the at least one radially extending portion arranged to engage the locking surface and prevent rotation of the elongate carrier.

10. The carrier assembly of claim 9, further comprising a spring connected between the at least one endplate and the latch, the spring biasing the latch toward a locking position.

11. The carrier assembly of claim 10, wherein the pocket further defines a spring pocket, and wherein the spring is disposed in the spring pocket.

12. The carrier assembly of claim 9, wherein the at least one toothed cam wheel forms two tangentially extending portions disposed diametrically opposite from each other along the outer portion thereof.

13. The carrier assembly of claim 12, wherein the at least one toothed cam wheel forms two radially extending portions disposed diametrically opposite from each other, each radially extending portion corresponding to each of the two tangentially extending portions.

14. The carrier assembly of claim 9, wherein the contacting surface of the trigger portion defines a first contacting surface, a transition surface, and a releasing surface.

15. The carrier assembly of claim 14, wherein the first contacting surface and the releasing surface extend tangentially with respect to a circle, and wherein the transition surface extends peripherally with respect to the circle.

16. The carrier assembly of claim 9, wherein the locking surface of the trigger portion is flat.

17. A method for selectively preventing rotation of a carrier associated with a bending brake, the carrier being rotatable along a first direction to align a selected one of a plurality of upper clamping jaws angularly arranged thereon with a lower clamping jaw associated with the bending brake, and tending to rotate along a second, opposite, direction during operation of the bending brake, the method comprising:

selectively rotating the carrier in the first direction with a drive mechanism from a locked position to a subsequent locked position, wherein rotation of the carrier is accomplished about an axis of rotation of the carrier;

causing rotation of a toothed cam wheel to occur through rotation of the carrier, rotation of the toothed cam wheel being proportional to rotation of the carrier;

pivotally rotating a latch about an axis of rotation of the latch that is parallel to the axis of rotation of the carrier, the rotation of the latch occurring from a locked position by gradually pushing on a trigger portion formed on the latch with a tooth formed on the toothed cam wheel;

releasing the latch back into the locked position when the latch is no longer pushed by the tooth; and preventing rotation of the carrier in the second direction by engaging a surface of the tooth that extends radially with respect to the toothed cam wheel with a stop formed on the trigger.

18. The method of claim 17, wherein the trigger portion includes a contacting surface that is arranged to slidingly engage the tooth of the toothed cam wheel and pivotally displace the latch while the toothed cam wheel rotates, and wherein the contacting surface comprises:

a circular cross section portion, a first contacting portion extending tangentially from the circular cross section portion at an angle, a transition portion extending peripherally along a segment of the circular cross section portion adjacent to the first contacting portion, and a release contacting portion extending tangentially from the circular cross section portion adjacent the transition portion.

19. The method of claim 17, wherein releasing the latch is accomplished by allowing the latch to pivot toward a center of the toothed cam wheel along a surface of the tooth that extends radially with respect to the toothed cam wheel.

20. The method of claim 17, wherein pivotal motion of the latch toward the locked position when the latch is released is accomplished by pulling the latch toward the locked position with a spring.

21. An endplate for use to rotatably support a distal end of a rotating carrier assembly on a bending brake, the endplate comprising:

a circular hub opening formed in the endplate and extending through the endplate, the circular hub opening having a centerline;

a latch pocket formed in the endplate along a face thereof that is opposite the rotating carrier, the latch pocket arranged to enclose a body portion of a latch, the latch having a trigger portion connected to the body portion and extending perpendicular thereto such that the trigger portion is external to the latch pocket at all times;

a pin pocket formed in the endplate adjacent to the latch pocket, the pin pocket arranged to receive a latch pin having a centerline extending in parallel to the centerline of the circular hub;

a stop block connected to the endplate and disposed within the latch pocket, the stop block arranged to contact the body portion of the latch when the latch is in a locked position;

wherein the endplate is adapted to pivotally receive the latch within the latch pocket, the latch connected to the endplate via the latch pin disposed in the pin pocket;

wherein the carrier is adapted to connect to the endplate via a toothed cam wheel, the toothed cam wheel having a hub portion concentrically disposed within the circular hub opening and a cam portion, the cam portion adapted to engage the latch when the toothed cam wheel is rotating; and wherein a dimensional relationship between the latch and the toothed cam wheel is controlled by a relative position between an outer diameter of the circular hub opening, a center point of the pin pocket, and the stop block to each other.

22. The endplate of claim 21, further including a spring pocket formed in the endplate adjacent to the latch pocket, wherein the spring pocket receives a spring connecting the latch with the endplate such that the spring is extended when the latch pivots away from the locked position and acts to pull the latch back toward the locked position to lock a position of the toothed cam wheel relative to the endplate.

* * * * *